United States Patent [19]

Ochmann

[11] 4,180,761

[45] Dec. 25, 1979

[54] CONTROL DEVICE, PARTICULARLY FOR CONTROLLING THE EMISSION CURRENT OF AN X-RAY TUBE

[75] Inventor: Rudolf Ochmann, Hamburg, Fed. Rep. of Germany

[73] Assignee: U.S. Philips Corporation, New York, N.Y.

[21] Appl. No.: 781,935

[22] Filed: Mar. 28, 1977

[30] Foreign Application Priority Data

Apr. 1, 1976 [DE] Fed. Rep. of Germany ..... 2613997

[51] Int. Cl.[2] ..... G05F 1/00; H05B 37/02; H05B 39/04; H05B 41/36

[52] U.S. Cl. ..... 315/292; 315/106; 330/85

[58] Field of Search ..... 307/355, 356, 359, 297, 307/157; 315/292, 307, 308, 106, 107; 330/85, 82, 86, 90, 95; 250/408, 409

[56] References Cited

PUBLICATIONS

Fink, *Electronic Engineers' Handbook.*

Fink & Carroll, *Standard Handbook for Electrical Engineers,* 10th Ed.

J. V. Wait, et al., Introduction to Operational Amplifier Theory and Applications, 1975, pp. 8, 9, 357-387.

Stout and Kaufman, Handbook of Op-Amp Circuit Design, 1976, pp. 1-12 and 1-13.

*Primary Examiner*—Alfred E. Smith

*Assistant Examiner*—Robert E. Wise

*Attorney, Agent, or Firm*—Thomas A. Briody; William J. Streeter; Bernard Franzblau

[57] ABSTRACT

A control device for controlling the emission current of an x-ray tube comprising a control circuit which receives a digital reference value signal and an amplifier whose gain is controlled by a portion of said digital reference value signal so as to provide a comparatively high accuracy for the emission current adjustment with a minimum number of binary positions.

14 Claims, 2 Drawing Figures

Figure 1:
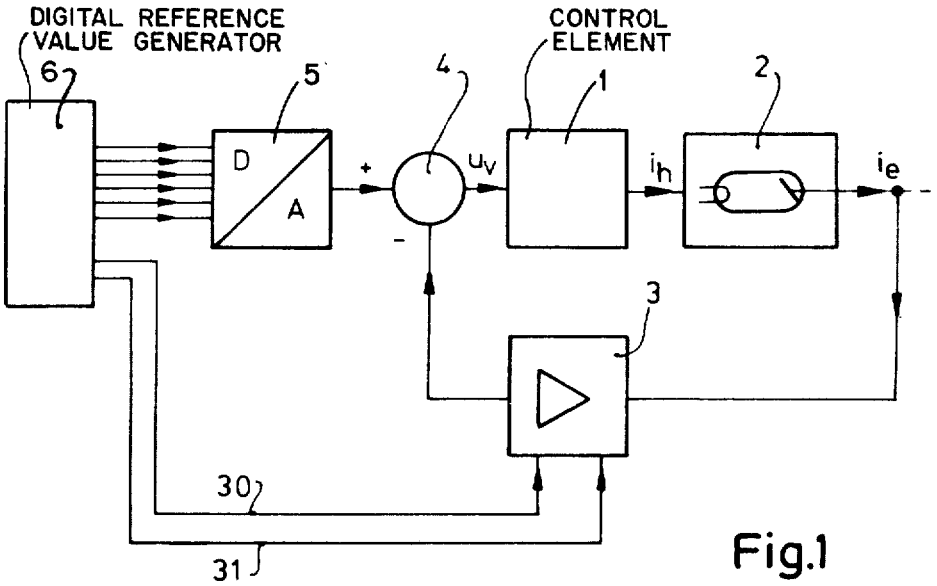

CONTROL DEVICE, PARTICULARLY FOR CONTROLLING THE EMISSION CURRENT OF AN X-RAY TUBE

The invention relates to a control device, particularly for controlling the emission current of an X-ray tube, comprising a digital reference value generator, a digital-to-analog converter, the input of which receives a digital value to be supplied by the reference value generator, and also comprising a control circuit which includes a comparison device for comparing the analog reference value with the actual value of the quantity to be controlled and for controlling, in the case of deviations, said quantity so as to reduce the deviation. A control device of this kind is known, for example, from German Offenlegungsschrift No. 21 54 235.

If the quantity to be controlled must be adjustable over a very wide range in control devices of this kind (in X-ray tubes the maximum emission current, for example, is more than 100 times larger than the minimum emission current) and if, furthermore, each value within this control range must be comparatively accurately adjustable, a comparatively large number of binary positions is required, for example, in the case of a binary coded representation of the reference value. Consequently, the digital-to-analog converter and also the digital reference value generator, for example a keyboard, are more complex.

The present invention has for an object to construct a control device of the kind set forth so that only a comparatively small number of binary positions is required for a reference value, even in the case of a comparatively large control range, and with adequate accuracy with relation to the value of the quantity to be controlled and each time to be adjusted.

A control device in accordance with the invention is characterized in that only part of the binary positions of the digital reference value supplied by the reference value generator are applied to the digital-to-analog converter, the remainder of the binary positions serving to control the amplification of an amplifier circuit for the reference value and/or the actual value, so that if the quantity to be controlled increased, the quotient of the reference value and the actual value at the input of the comparison device is step-wise increased.

Thus, in accordance with the invention, the binary positions of the digital reference value are subdivided into a part which is applied to the digital-to-analog converter, and into another part which controls the amplification. For example, if two binary positions (of a total of eight) are used for changing the amplification, the amplification can be increased in three steps at the most. If it is also assumed that six binary coded binary positions are applied to the digital-to-analog converter, and if it is assumed that the amplification changes by a factor of 2, from one step to the other, a minimum reference value 1 and a maximum reference value $(2^6-1)\cdot 2^3=504$ can be adjusted by means of this control arrangement. This control range can be further increased by increasing the steps, for example, each time by a factor of 4. In contrast, if all all of the binary positions were binary coded, a maximum range of values of between 1 and $2^8-1=255$ could be realized.

In the control device in accordance with the invention, the relative error (related to the value to be adjusted and caused by quantizing) is not larger than if the reference value were given exclusively in binary coded form. The quantizing error is larger in the upper value range in the control device in accordance with the invention than in a device where the reference values are given exclusively in binary coded form because the absolute level of the steps in this range is a factor $2^3$ larger than in the case of a value represented in binary coded form, but this is not a drawback because the reduction of the quantizing error in the upper value range cannot be utilized anyway. It is essentially more important for the quantizing error to remain substantially constant over the total range (in the case of the binary code, the quantizing error is inversely proportional to the value concerned) and this is at least substantially achieved in the control device in accordance with the invention.

The quotient of the reference value and the actual value at the input of the comparison circuit can in principle be increased in steps by connecting the amplifier circuit between the output of the digital-to-analog converter and the reference value input of the comparison device and by increasing its amplification in steps.

An elaboration of the control device in accordance with the invention, which is attractive notably for control devices in which the loop amplification in the control circuit increases as the quantity to be controlled increases (for example, the emission current in X-ray tubes increases exponentially with the filament current of the X-ray tube so that the transmission factor of this control traject increases exponentially), consists in that the actual value of the comparison device is applied via the amplifier device, the amplification of which can be controlled by the remaining binary positions so that the amplification of the actual value is step-wise reduced as the reference value increases. Consequently, in the case of an increasing quantity to be controlled (for example, in the case of an increasing emission current), the loop amplification is increased less, if not compensated for, so that the stability of the control circuit can be ensured in a simpler manner. However, the most important aspect is that the ratio between the output voltage of the amplifier circuit and the relevant quantity to be controlled is smaller in the case of a high value of said quantity than in the case of a low value. This means that the change range (ratio between maximum value and minimum value) of the output voltage is essentially smaller than the change range of the quantity to be controlled. However, if the amplifier circuit were connected instead between the comparison device and the output of the digital-to-analog converter via which the reference value component is applied, the change range of the output voltage would be equal to the change range of the quantity to be controlled. If the change range of the said quantity is then essentially larger than 100—as is the case, for example, for the emission current of an X-ray tube—this would require a corresponding change in the output voltage of the amplifier circuit connected in the reference value branch. However, usually the commercially available operational amplifiers can only process output voltages between approximately 100 mV and 10 V with adequate accuracy, i.e., the maximum change range is limited to 100. As a result of this elaboration, the use of amplifier circuits of this kind is also possible in the case of a change range exceeding 100.

It is in principle possible for the amplification to be decreased in steps of different value. However, a simpler construction of a control device in accordance with the invention, in which the quotient of the reference value and the actual value increases by at least two steps with increasing quantity to be controlled is characterized in that the steps differ each time by the same factor.

A particularly simple embodiment of a control device in accordance with the invention is characterized in that the binary positions supplied to the digital-to-analog converter each time represent a binary coded value, the amplification factor of the amplifier circuit being adjustable each time in steps, which differ by a factor of 2 relative to each other. This elaboration enables particularly simple coding and decoding of the reference values.

A further elaboration of the control device in accordance with the invention is characterized in that the amplifier circuit comprises an operational amplifier having an inverting input. A first resistance element is connected between the output and the inverting input, and a second resistance element is connected in a signal lead to the inverting input, one resistance element or both resistance elements each being controllable by means of a switch in dependence on the remaining part of the binary positions. The amplification of an operational amplifier of this kind corresponds to the quotient of the resistance of the first resistance element and the resistance of the second resistance element so that it can be changed in steps by the switching of the resistance elements.

Figure 2:
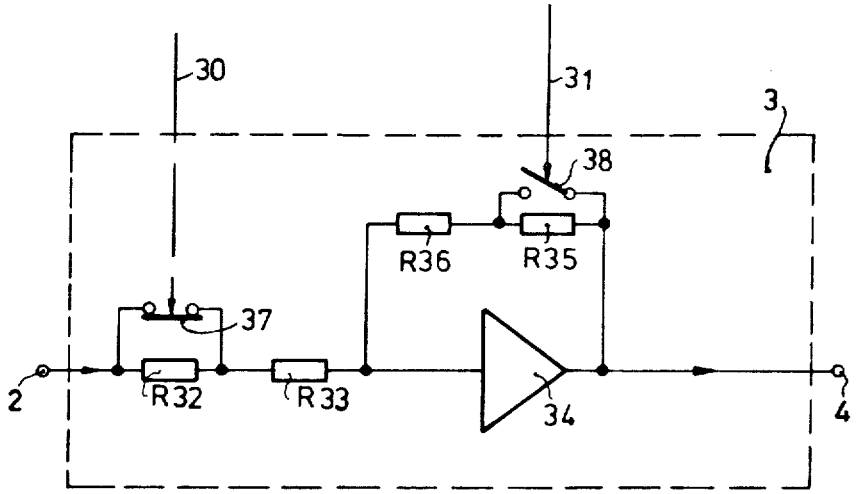

The invention will be described in detail hereinafter with reference to an embodiment shown in the accompanying drawing in which:

FIG. 1 is the block diagram of a control device in accordance with the invention for controlling the emission current of an X-ray tube, and FIG. 2 shows an embodiment of an amplifier circuit whose amplification can be controlled in steps.

The control device comprises a control element 1 which adjusts the filament current $i_h$ of a diagrammatically shown X-ray tube 2 in dependence on the input voltage $u_v$ applied to this control element. Control devices of this kind for adjusting the emission current of an X-ray tube are known per se (for example, from German Offenlegungsshrift No. 24 48 754, or U.S. Pat. No. 3,983,396). The actual value of the emission current, which can be obtained, for example, on the basis of the voltage drop across a resistor (not shown) in the high voltage circuit of the X-ray tube 2, is applied, via an amplifier 3, to one input of a comparison device 4, e.g. a conventional differential amplifier, the other input of which receives the output signal of a conventional digital-to-analog converter 5. The output of the comparison device 4 supplies the comparison signal $u_v$ which is dependent on the difference between the output signals of the digital-to-analog converter 5 and of the amplifier 3, the said comparison signal $u_v$ causing a change of the filament current $i_h$ and hence of the emission current $i_e$ so that the difference between the two output signals is minimized.

The input of the digital-to-analog converter 5 receives a digital binary coded value comprising six binary positions in parallel from a digital reference value generator 6. The digital reference value generator may consist of a PROM (Programmable Read Only Memory) wherein reference values are stored at several addresses. Setting the tube voltage and emission current, an address containing the appropriate reference value for the heating current is chosen. The method of choosing the right address is not a part of the invention, but it could be done by connecting the control knobs for setting the tube voltage and emission current each to a potentiometer slider. The analog voltage on the sliders may be converted into a digital number by a conventional analog/digital converter. Both digital numbers together will form the address for selecting the desired heating current reference value. Two further binary positions of the digital output signal of the reference value generator 6 are simultaneously applied, via leads 30 and 31, to the amplifier 3 for a step-wise variation of its amplification. When the amplification of this amplifier 3 is reduced, for example, by the factor 4, the same effect is obtained as if the amplification of an amplifier connected between the output of the digital-to-analog converter 5 and the input of the comparison device 4 were increased by a factor of 4. However, in the arrangement shown in FIG. 1 the described advantage is obtained in that the stability of the control device is improved and in that less severe requirements are to be imposed on the amplifier 3.

Because the control signal on the leads 30, 31 can assume a total of four states (00, 01, 10, 11), four different amplification factors can be adjusted via the leads 30 and 31, so that if the amplification factor is to be changed from stage to stage each time by the factor 4, the amplifications $V_0$, 4 $V_0$, 16 $V_0$ and 64 $V_0$ can be adjusted, $V_0$—preferably = 1—being a constant amplification factor. The largest binary coded value which can be formed by means of six binary positions is $2^6-1=63$, so that for $V_0=1$, the largest reference value which can be adjusted is $63.4^3=4032$. The smallest value (not 0) is 1, so that by means of eight binary positions a value range of 4032:1 can be formed, the lowest value thereof, however, then including a comparatively large stepping error. If a restriction is therefore made to values larger than 16, there still is a value range of 252:1 and the maximum stepping error (in the lower value range) then corresponds to half the reciprocal value of the lowest stage, so 3.25%. If the eight output leads of the digital reference value generator 6 had been used for a purely binary coded representation of a reference value, the maximum feasible value range would have been 255:1 and the maximum relative stepping error (in the lower value range) would have been 50%.

The amplification of the amplifier 3 has its highest value (for example, 64) for the smallest reference value to be produced. As the reference value increases, this amplification initially remains constant and only the binary coded reference value appearing on the connection leads between the digital reference value generator 6 and the digital-to-analog converter 5 changes correspondingly, until the maximum value which can be represented in binary code with six binary positions is reached ($2^6-1=63$). If the reference value increases still further, the amplification of the amplifier 3 is reduced by the factor 4 (to 16) and the value 16 appears in binary coded form at the input of the digital-to-analog converter 5. Because the reduction of the amplification of the actual value by a factor of 4 in principle has the same effect (in the case of perfect adjustment) as an increase of the amplification of the reference value by a factor 4, this change of the amplification factor on the one hand and that of the value applied to the digital-to-analog converter 5 on the other hand has the same effect as if the reference value were changed from 63 to $4\times16=64$. If the reference value further increases, first only the binary coded value on the input of the digital-to-analog converter 5 changes again until the largest value which can be represented in binary coded form by means of six binary position is reached again at the input of the digital-to-analog converter 5, after which the amplification is again reduced by the factor 4 (to 4) and the binary coded value 16 is applied to the digital-to-analog converter 5, etc.

The selection of a power of two $2^n$ (n being an integer positive number, in this case n=2) for the "amplification reduction factor" offers the advantage that the formation of a reference value which is suitable for the digital reference value generator 6 (and the formation of a binary coded value from a reference value) is particularly simple because the switching over of the amplification by one step corresponds to a shift of the binary coded component of the reference value over n positions in a shift register because, as is known, a shift of a binary coded number over n positions corresponds to a multiplication or a division by $2^n$. For small values of $2^n$ (for example, 4) small relative stepping errors occur. Higher values of $2^n$ (for example, 8) result in a larger value range.

FIG. 2 shows an embodiment of the amplifier 3. A signal which is derived from the control device and which is proportional to the actual value of the emission current $i_e$ is applied, via the series connection of the two resistors $R_{32}$ and $R_{33}$, to the inverting input of an operational amplifier 34, the output of which is connected to the input via the series connection of a resistor $R_{35}$ and a further resistor $R_{36}$. The output of amplifier 34 is connected to an input of the comparison device 4 (FIG. 1). The normally closed contact 37 of a switch which is to be actuated via the lead 30 is connected parallel to the resistor $R_{32}$, and the normally open contact 38 of a switch which is to be actuated via the lead 31 is connected parallel to the resistor $R_{35}$. The amplification is then determined by the quotients of the resistance between the output and the input and the resistance in the input lead of the operational amplifier 34. The highest amplification is obtained in the switch positions shown, i.e. at $(R_{35}+R_{36})/R_{33}$. The lowest amplification is obtained when the normally closed contact 37 is open and the normally open contact 38 is closed, at $R_{36}/(R_{32}+R_{33})$. Therebetween the amplification values $(R_{36}+R_{35})/(R_{32}+R_{33})$ and $R_{36}/R_{33}$ are situated.

If the following relations $$R_{32}=(2^n-1)\cdot R_{33},$$

$$R_{36}=2^n\cdot R_{33} \text{ and}$$

$$R_{35}=(2^{3n}-2^{2n})\cdot R_{33}$$

are satisfied for the resistors, the amplification decreases each time in steps of $2^n$ as the reference value increases, if the switches initially occupy the position shown in FIG. 2 subsequently, first the normally closed contact 37 is opened, and after that the normally closed contact 37 is closed again and the normally open contact 38 is also closed, after which the normally closed contact 37 is opened and the normally open contact 38 remains closed.

What is claimed is:

1. A control device for controlling the emission current of an X-ray tube comprising, a digital reference value generator having a plurality of binary positions, a digital-to-analog converter having an input coupled to receive a digital value signal supplied by the reference value generator and an output at which a corresponding analog reference value signal is produced, only a part of the binary positions of the digital reference value generator being coupled to the input of the digital-to-analog converter, a comparison device for comparing the analog reference value signal with a signal representing the actual value of the emission current and for controlling, in the event of a deviation therebetween, the emission current so as to reduce the deviation, an amplifier circuit for amplifying at least one of the compared signals, and means coupling the remainder of the binary positions of the digital reference value generator to a control input of the amplifier circuit to control the amplification thereof so that if the emission current increases, the quotient of the reference value signal and the actual value signal at the input of the comparison device is step-wise is to be increased.

2. A device as claimed in claim 1, wherein the actual value signal is applied to the comparison device via the amplifier circuit, the amplification of which is controlled by the remaining binary positions of the reference value generator so that the amplification of the actual value signal decreases step-wise as the reference value increases.

3. A device as claimed in claim 1, in which the quotient of the reference value signal and the actual value signal at the input of the comparison device increases by at least two steps as the emission current to be controlled increases, characterized in that the steps differ each time by the same factor.

4. A device as claimed in claim 1, wherein the binary positions supplied to the digital-to-analog converter each time represent a binary coded value, the amplification factor of the amplifier circuit being adjustable each time in steps which differ by a factor of two relative to each other.

5. A device as claimed in claim 1 wherein the amplifier circuit comprises an operational amplifier with an inverting input, a first resistance element connected between the output and the input and a second resistance element connected in the signal lead to the inverting input, the value of a resistance element or both resistance elements being controllable by means of a switch controlled by the remaining part of the binary positions.

6. A device as claimed in claim 5, comprising two binary positions of the reference value generator for controlling the amplification, wherein the signal lead to the inverting input of the operational amplifier includes the series connection of a first and a second resistor, the second resistor being bridged by a normally closed contact which can be controlled in dependence on a first binary position and being $2^n-1$ times larger than the first resistor, a series connection of a third and a fourth resistor connected between the inverting input of the amplifier and its output, the third resistor being $2^n$ times larger than the first resistor, the fourth resistor being bridged by a normally open contact which can be controlled in dependence on the second binary position and being a factor $2^{3n}-2^n$ larger than the first resistor.

7. A control device for controlling an electric quantity comprising, a digital reference value generator having a plurality of binary positions for forming a digital reference value signal, a digital-to-analog converter having input means coupled to a part of the binary positions of the reference value generator so as to receive therefrom a part of the digital reference value signal and having an output at which a corresponding analog reference value signal is produced, a comparison device for comparing the analog reference value signal with a signal representing the actual value of said electric quantity, means responsive to the output of the comparison device for controlling the electric quantity in a sense to reduce any deviation between the analog reference value signal and the actual value signal, amplifier means connected in circuit so as to amplify at least one of the compared signals, and means coupling the remaining part of the binary positions of the digital reference value generator to a control input of the amplifier means so as to vary the amplification thereof in steps so that for increasing values of the electric quantity the quotient of the reference value signal and the actual value signal appearing at the input of the comparison device is increased in steps.

8. A control device as claimed in claim 7 wherein the amplifier means is coupled in a feedback loop between the output of said controlling means and the input of the comparison device so as to control the actual value signal, the amplification of the amplifier means being controlled so that the amplification of the actual value signal decreases in steps as the electric quantity is increased.

9. A control device as claimed in claim 8 wherein the amplification factor of the amplifier means is adjustable in steps which differ each time by the same factor.

10. A control device as claimed in claim 8 wherein the amplification factor of the amplifier means is adjustable in steps which differ each time by a factor of two relative to each other.

11. A control device as claimed in claim 10 wherein the amplifier means comprises an operational amplifier having an inverting input and an output, first resistance means connected between said output and input of the operational amplifier, second resistance means connected in a signal lead going to the amplifier inverting input, and switching means for adjusting the resistance value of at least one of said resistance means under the control of the remaining part of the binary positions of said digital reference value generator.

12. A control device for controlling an electric quantity comprising, a digital reference value generator having a plurality of binary positions divided into first and second parts which together form a digital reference value signal, a digital-to-analog converter having input means coupled to said first part of the binary positions of the reference value generator so as to receive therefrom a part of the digital reference value signal and having an output at which a corresponding analog reference value signal is produced, a comparison device for comparing the analog reference value signal with a signal representing the actual value of said electric quantity to derive a control quantity at an output thereof, means responsive to the output of the comparison device for controlling the electric quantity in a sense to reduce any deviation between the analog reference value signal and the actual value signal, amplifier means connected in circuit so as to amplify at least one of the compared signals, and means coupling the second part of the binary positions of the digital reference value generator to a control input of the amplifier means so as to vary the amplification thereof in steps so that the control quantity can be varied in steps by a variation of either the first or second part of the digital reference value signal.

13. A control device as claimed in claim 12 wherein the amplifier means is coupled in a feedback loop between the output of said controlling means and the input of the comparison device so as to control the actual value signal, the amplification of the amplifier means being controlled so that the amplification of the actual value signal is decreased in steps for a desired increase in the value of the electric quantity.

14. A control device as claimed in claim 12 wherein the amplification factor of the amplifier means is adjustable in steps which differ each time by a factor of $2^n$ relative to each other, where n is an integer.

* * * * *